US006802766B2

(12) United States Patent
Liu

(10) Patent No.: US 6,802,766 B2
(45) Date of Patent: Oct. 12, 2004

(54) AIR-GUIDING STRUCTURE FOR AN AIR SANDER

(75) Inventor: You-Jie Liu, Taichung (TW)

(73) Assignee: Basso Industry Corp., Taichung (TW)

( * ) Notice: Subject to any disclaimer, the term of this patent is extended or adjusted under 35 U.S.C. 154(b) by 15 days.

(21) Appl. No.: 10/282,390

(22) Filed: Oct. 30, 2002

(65) Prior Publication Data

US 2004/0087264 A1 May 6, 2004

(51) Int. Cl.[7] ..... B24B 55/04

(52) U.S. Cl. ..... 451/451; 451/449; 451/453; 451/356; 451/357; 173/169

(58) Field of Search ..... 451/451, 449, 451/453, 456, 356, 357; 173/69, 169

(56) References Cited

U.S. PATENT DOCUMENTS 5,228,244 A * 7/1993 Chu ..... 451/456
5,319,888 A * 6/1994 Huber et al. ..... 451/357
5,580,302 A * 12/1996 Howard et al. ..... 451/357
5,595,530 A * 1/1997 Heidelberger ..... 451/356
5,879,228 A * 3/1999 Sun ..... 451/357
5,919,085 A * 7/1999 Izumisawa ..... 451/357
6,004,197 A * 12/1999 Huber ..... 451/456
6,338,389 B1 * 1/2002 Chang ..... 173/169

* cited by examiner

*Primary Examiner*—Joseph J. Hail, III
*Assistant Examiner*—Alvin J Grant
(74) *Attorney, Agent, or Firm*—Charles E. Baxley

(57) ABSTRACT

An air-guiding structure for an air sander includes a muffler assembly integrally formed from plastic material, a main passageway and a sub-passageway formed in the muffler assembly, a dust collection port formed at a bottom end of the sub-passageway, and a baffle integrally formed within the main passageway to divide the main passageway into a front section and a rear section. One side of the main passageway communicates with the sub-passageway, and the main passageway has a joint port and an exhaust port opposite to the joint port. The joint port and the dust collection port of the muffler assembly connect to the outlet port and joint port of the air sander, respectively. The baffle is formed with a predetermined number of thin holes to communicate the front section with the rear section, wherein the rear section of the main passageway communicates with the sub-passageway.

1 Claim, 4 Drawing Sheets

AIR-GUIDING STRUCTURE FOR AN AIR SANDER

BACKGROUND OF THE INVENTION

1. Field of the Invention

The invention relates to an air-guiding structure for an air sander, and in particular to an air-guiding structure including a muffler assembly integrally formed with a main passageway, a sub-passageway, and a baffle arranged in the main passageway to divide the main passageway into a front section and a rear section, so that the manufacturing and assembling costs may be lowered.

2. Description of the Related Art

A conventional air sander is formed with an inlet port and an outlet port. An air stream may enter the sander through the inlet port to drive a rotor to rotate, and then the air stream may exit the sander through the outlet port so that the air stream may circulate smoothly. In general, the operation modes of the conventional air sander may be divided into a non-suction mode and a self-suction mode. Under the non-suction mode, the air stream is directly exhausted from the outlet port. In the sander with the self-suction mode, the outlet port is connected to a muffler assembly having a main passageway directly communicating with the outlet port of the air sander and a sub-passageway communicating with a lateral side of a middle section of the main passageway. When the air stream is exhausted from the outlet port, the exhausted air stream may flow out from the main passageway. On the other hand, the air in the sub-passageway communicating with the lateral side of the main passageway is dragged by the air stream exhausted from the main passageway, and a dragged air stream is generated in the sub-passageway accordingly. The dust may be collected, sucked and exhausted by the sander using the dragged air stream in the sub-passageway.

Please refer to FIG. 1, which shows a muffler assembly 10 attached to a conventional air sander with the self-suction mode. The muffler assembly 10 includes a bifurcated tube 11, an inner tube 12 and a tail tube 13 assembled and connected as shown in FIG. 1. The bifurcated tube 11 is a tube formed with a main passageway 111 and a sub-passageway 112. The inner tube 12 is arranged between the main passageway 111 and sub-passageway 112 in the bifurcated tube 11 to separate the main passageway 111 from the sub-passageway 112. The tail tube 13 is connected to the tail end of the bifurcated tube 11. The conventional muffler assembly 10 with three assembled members may achieve the object of the self-suction function of the air sander. However, the conventional muffler assembly has too many members, thereby significantly increasing the manufacturing and assembling costs.

Consequently, the drawbacks of the conventional muffler assembly may be overcome if the muffler assembly may be integrally formed. However, it is difficult to integrally form the muffler assembly due to mold limitations and special structures in which the main passageway is formed with a main passageway and a sub-passageway, an inner tube is arranged between the main passageway and the sub-passageway, the communication port between the main passageway and the tail tube is small, the communication port between the sub-passageway and the tail tube is large, and the like.

SUMMARY OF THE INVENTION

A primary object of the invention is to provide an air-guiding structure for an air sander capable of solving the above-mentioned problems.

According to one aspect of the invention, an air-guiding structure for an air sander includes a muffler assembly integrally formed from plastic material, a main passageway and a sub-passageway formed in the muffler assembly, a dust collection port formed at a bottom end of the sub-passageway, and a baffle integrally formed within the main passageway to divide the main passageway into a front section and a rear section. One side of the main passageway communicates with the sub-passageway, and the main passageway has a joint port and an exhaust port opposite to the joint port. The joint port and the dust collection port of the muffler assembly connect to the outlet port and joint port of the air sander, respectively. The baffle is formed with a predetermined number of thin holes to communicate the front section of the main passageway with the rear section of the main passageway, wherein the rear section of the main passageway communicates with the sub-passageway. According to the above-mentioned structure, the muffler assembly of the invention may be formed integrally, and the manufacturing and assembling costs may be greatly lowered.

Further benefits and advantages of the present invention will become apparent after a careful reading of the detailed description with appropriate reference to the accompanying drawings.

DETAILED DESCRIPTION OF THE INVENTION

Figure 1:
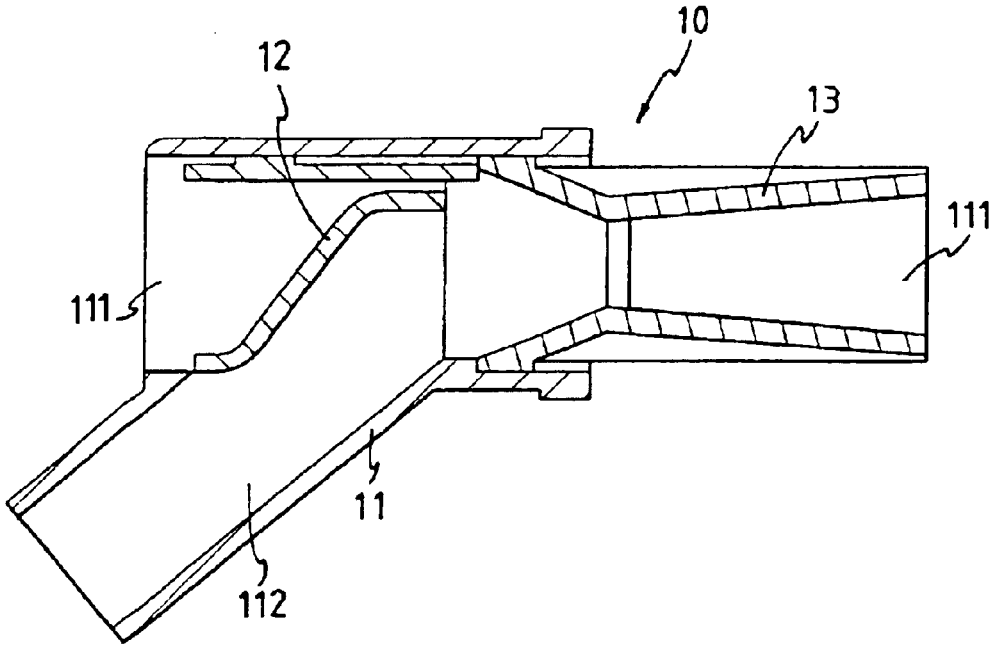
FIG. 1 PRIOR ART
FIG. 1 is a schematically cross-sectional view showing a conventional muffler assembly for a conventional air sander.
Figure 2:
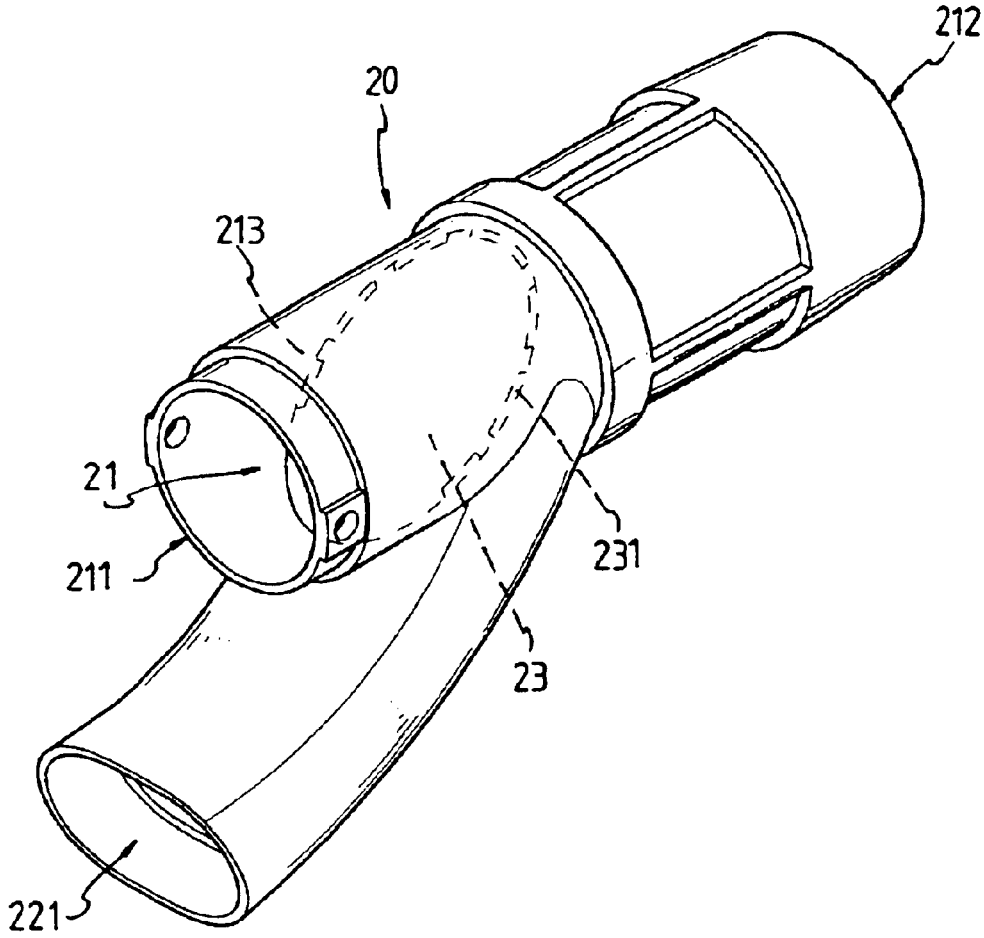
FIG. 2 is a pictorial view showing a muffler assembly of the invention.
Figure 3:
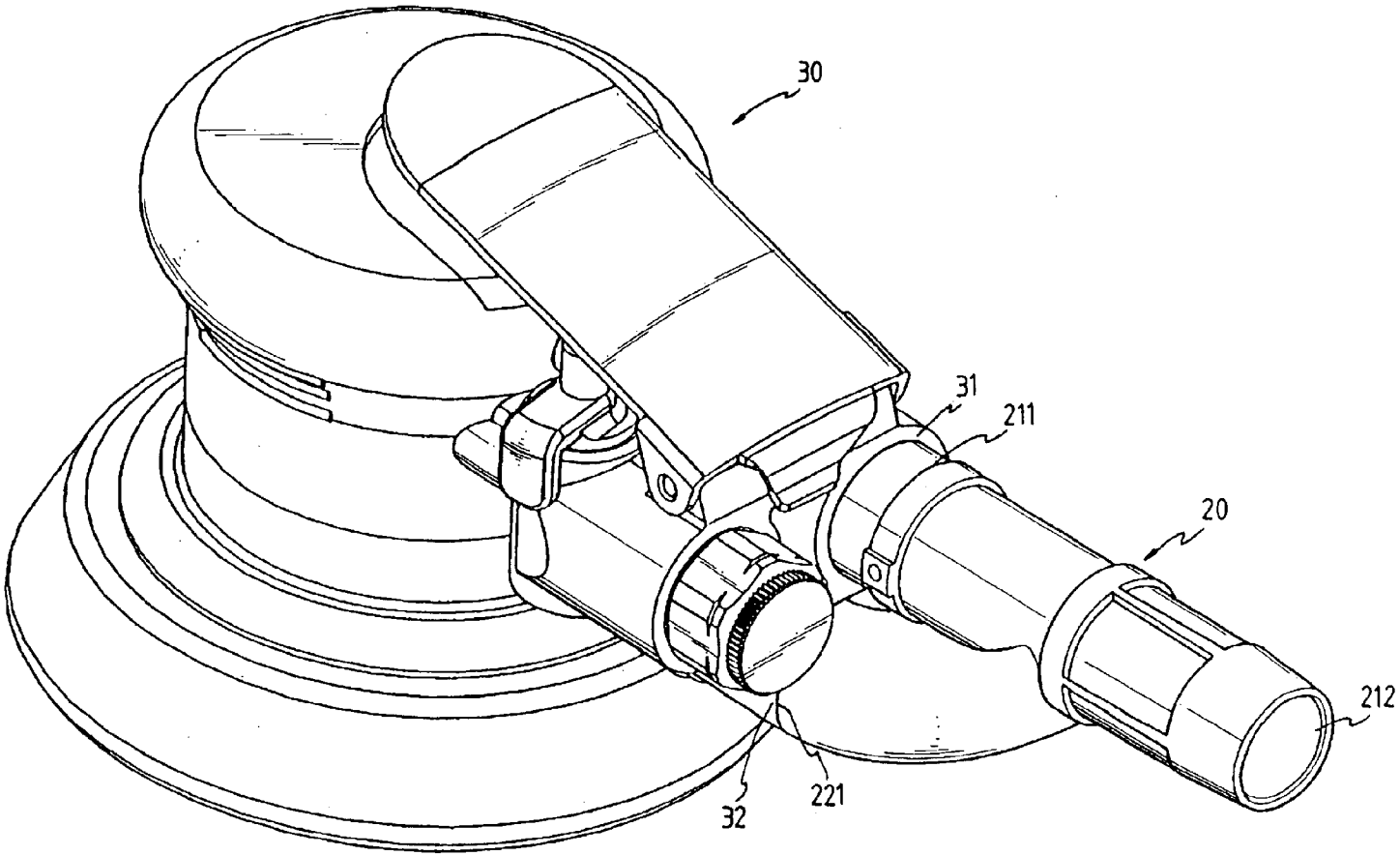
FIG. 3 is a pictorial view showing the combination of the air sander and the muffler assembly of the invention.
Figure 4:
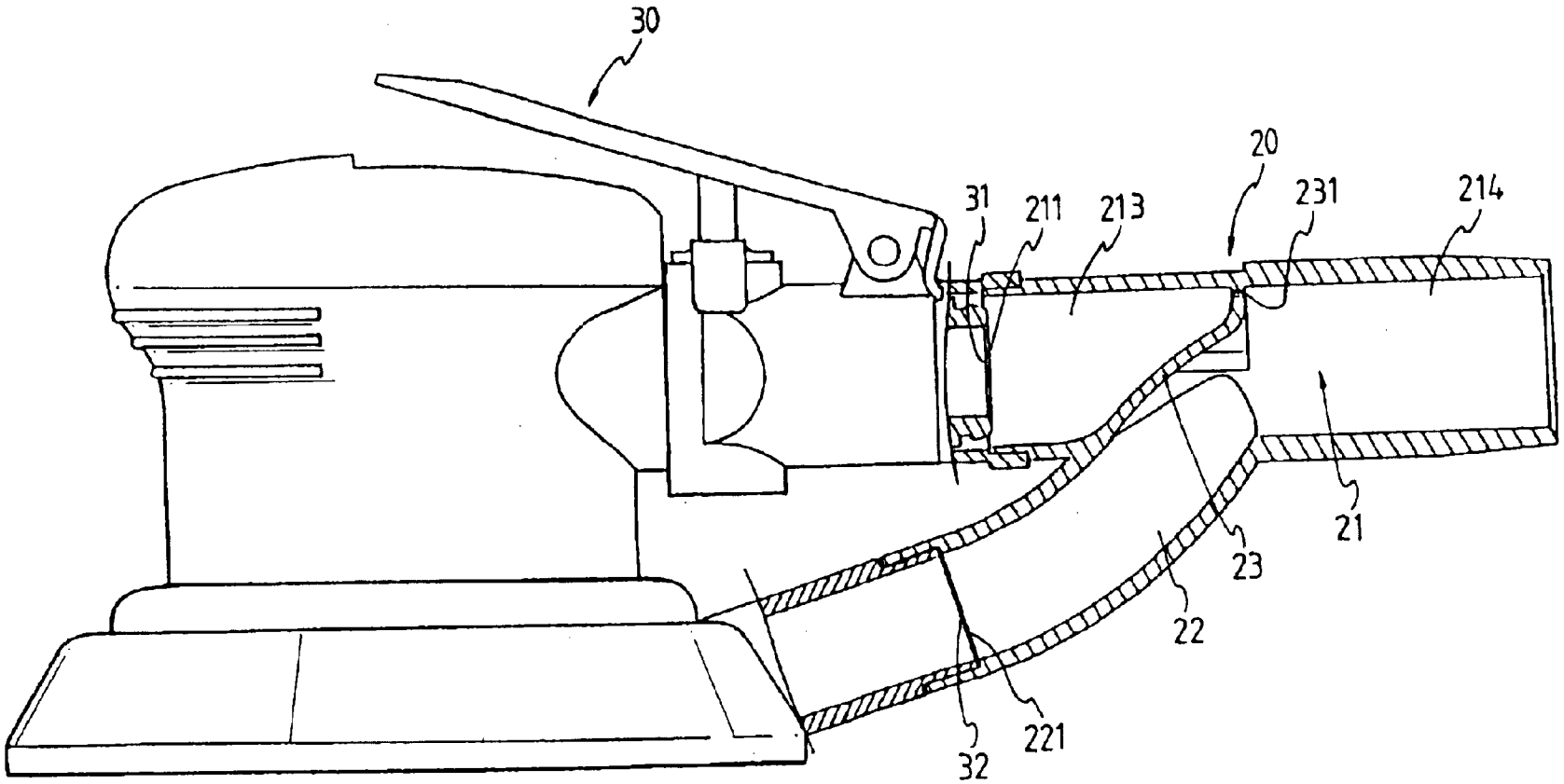
FIG. 4 is a schematically and partially cross-sectional view showing the combination of the air sander and the muffler assembly of the invention.

Referring to FIGS. 2 to 4, an air-guiding structure for an air sander according to one embodiment of the invention is characterized in that a muffler assembly attached to the air sander is improved.

The muffler assembly 20 is integrally formed from plastic material and is formed with a main passageway 21 and a sub-passageway 22. One side of the middle section of the main passageway 21 directly communicates with the sub-passageway 22. The main passageway 21 has two ends formed with an open-ended joint port 211 and an exhaust port 212 while the sub-passageway 22 has one end formed with a dust collection port 221. Accordingly, the joint port 211 and the dust collection port 221 of the muffler assembly 20 are connected to an outlet port 31 and a joint port 32 respectively, of the air sander 30, to perform the self-suction operation.

Particularly, it is to be noted that a baffle 23 is integrally formed in the main passageway 21 of the invention to divide the main passageway 21 into a front section 213 and a rear section 214. Furthermore, the baffle 23 is formed with a predetermined number of thin holes 231. The front section 213 may communicate with the rear section 214 of the main passageway 21 through the thin holes 231, and the rear section 214 of the main passageway 21 may directly communicate with the sub-passageway 22 through a large aperture.

According to the above-mentioned structure, it should be understood that the invention provides a muffler assembly integrally formed with a main passageway, a sub-passageway, and a baffle arranged in the main passageway to divide the main passageway into a front section and a rear section. The front section and the joint port may communicate with the rear section and the exhaust port respectively, through the small holes formed in the baffle. The sub-passageway with a larger aperture may communicate with the rear section of the main passageway with the aid of the separation of the baffle. Accordingly, the muffler assembly of the invention may be integrally formed and may meet the requirement of the self-suction operation for an air sander so that the manufacturing and assembling costs may be lowered.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. An air-guiding structure for an air sander, comprising:

a muffler assembly integrally formed from plastic material;

a main passageway and a sub-passageway formed in the muffler assembly, one side of the main passageway communicating with the sub-passageway, wherein the main passageway having a joint port and an exhaust port opposite to the joint port;

a dust collection port formed at a bottom end of the sub-passageway, wherein the joint port and the dust collection port of the muffler assembly connect to the outlet port and the joint port respectively, of the air sander; and a baffle integrally formed within the main passageway to divide the main passageway into a front section and a rear section, the baffle being formed with a predetermined number of small holes to communicate the front section of the main passageway with the rear section of the main passageway, wherein the rear section of the main passageway communicates with the sub-passageway.

* * * * *